US009500193B2

(12) United States Patent
Knight et al.

(10) Patent No.: US 9,500,193 B2
(45) Date of Patent: Nov. 22, 2016

(54) SUMP PUMP MONITORING DEVICE AND METHOD

(71) Applicant: Sears Brands, L.L.C., Hoffman Estates, IL (US)

(72) Inventors: Colin G. Knight, Winnetka, IL (US); Milos Coric, Lincolnshire, IL (US)

(73) Assignee: SEARS BRAND, L.L.C., Hoffman Estates, IL (US)

( * ) Notice: Subject to any disclaimer, the term of this patent is extended or adjusted under 35 U.S.C. 154(b) by 239 days.

(21) Appl. No.: 14/187,642

(22) Filed: Feb. 24, 2014

(65) Prior Publication Data

US 2015/0240803 A1 Aug. 27, 2015

(51) Int. Cl.

| | |
|---|---|
| ***F04B 51/00*** | (2006.01) |
| ***F04B 49/06*** | (2006.01) |
| ***F04B 49/04*** | (2006.01) |
| ***F04B 17/03*** | (2006.01) |

(52) U.S. Cl.

CPC ..... *F04B 51/00* (2013.01); *F04B 17/03* (2013.01); *F04B 49/04* (2013.01); *F04B 49/065* (2013.01)

(58) Field of Classification Search

None

See application file for complete search history.

(56) References Cited

U.S. PATENT DOCUMENTS

| | | | | |
|---|---|---|---|---|
| 5,672,050 | A * | 9/1997 | Webber | F04B 49/022 417/18 |
| 6,375,430 | B1 * | 4/2002 | Eckert | F04D 15/0218 417/36 |
| D740,698 | S * | 10/2015 | Cummings | D10/49 |
| 9,157,434 | B2 | 10/2015 | Leonard et al. | |
| 2003/0049134 | A1 | 3/2003 | Leighton et al. | |
| 2007/0258827 | A1 | 11/2007 | Gierke | |
| 2008/0031752 | A1 | 2/2008 | Littwin et al. | |
| 2014/0202243 | A1 * | 7/2014 | Leonard | F04B 23/021 73/168 |
| 2015/0143894 | A1 * | 5/2015 | Cummings | F04D 15/0088 73/168 |
| 2015/0143896 | A1 * | 5/2015 | Cummings | F04D 13/086 73/168 |
| 2015/0143900 | A1 * | 5/2015 | Cummings | G01F 23/74 73/308 |
| 2015/0147190 | A1 * | 5/2015 | Cummings | F04B 49/02 417/36 |
| 2015/0292501 | A1 * | 10/2015 | Knight | F04B 51/00 324/511 |
| 2015/0322951 | A1 * | 11/2015 | Bishop | F04B 17/06 417/38 |

OTHER PUBLICATIONS

"Current Clamp", Wikipedia, the free encyclopedia, 4 pages, dated Jan. 31, 2014.

"Pitboss—Easy to Install Pump and Water Alarm, No Phone Line or WiFi Network Needed", www.pumpalarm.com, 4 pages, dated Jan. 29, 2014.

"Making Sense of Home Area Network Choices", www.arrayent.com, 4 pages, dated Jan. 31, 2014.

(Continued)

*Primary Examiner* — Andre Allen

(74) *Attorney, Agent, or Firm* — McAndrews, Held & Malloy, Ltd.

(57) ABSTRACT

A method and device are disclosed for monitoring a sump pump system. The monitoring device may include electrical sensors to sense electrical characteristics of the sump pump system. The sensors may include one or more current clamps which may be clamped around an electrical lead or wire of the sump pump system. The monitoring device may further include control logic circuitry configured to monitor sensed electrical characteristics of the sump pump system and deduce an operating status based on the sensed electrical characteristics. The monitoring device may further include a communications interface configured to report the deduced operating status to an interested party via a communications device.

20 Claims, 7 Drawing Sheets

(56) References Cited

OTHER PUBLICATIONS

"On the Go? Know your Basement is Protected", www.waynepumps.com, 1 page, dated Jan. 29, 2014.

"Overview", www.arrayent.com, 4 pages, dated Jan. 31, 2014.

"Pitboss—Wireless Alarm System", www.verizonwireless.com/news/article, 5 pages, dated Jan. 29, 2014.

"Pitboss—Power Alarm, Power Failure Alarm with Text Message Alerts", www.pumpalarm.com, 2 pages, dated Jan. 29, 2014.

* cited by examiner

SUMP PUMP MONITORING DEVICE AND METHOD

FIELD OF THE INVENTION

Various embodiments relate to sump pump systems, and more particularly, to monitoring operation of sump pump systems and warning owners of potential issues.

BACKGROUND OF THE INVENTION

Home basements commonly include perimeter drains that funnel water toward a water collecting sump. A sump pump removes water that has accumulated in the sump and discharges the water away from the home. Since the perimeter drains funnel water toward the sump, the sump may overflow if the sump pump is non-operational or otherwise unable to discharge water from the sump faster than the flow of water into the sump.

The sump pump is typically powered by the main AC electrical system of the home, which may present an issue during a prolonged power outage since the sump pump would be unable to discharge water collected in the sump. Due to the possibility of a power outage, many sump pump systems include a backup pump that is powered by a DC battery. In such systems, the backup pump may continue to discharge water from the sump during power outages and potentially prevent costly water damage resulting from a sump overflow.

During heavy storms water may be delivered to the sump at a rate faster than the main pump is capable discharging. The backup pump may be configured to aid the main pump in such situations. In particular, the backup pump may have a float or other sensor that triggers operations of the backup pump when the water level exceeds a normal operating level. In such situations, both the main pump and backup pump may simultaneously discharge water from the sump at a combined rate greater than either pump acting alone.

Thus, proper operation of the sump pump system is crucial to maintaining a dry basement and avoiding costly water damage. In light of this, various warning systems and alarms have been created that sound an audible alarm when a malfunction or possible flooding condition is detected. Existing warning systems provide some additional protection against flooding. However, limitations and disadvantages of such conventional and traditional approaches should become apparent to one of skill in the art, through comparison of such systems with aspects of the present invention as set forth in the remainder of the present application.

BRIEF SUMMARY OF THE INVENTION

Apparatus and methods for monitoring operation of a sump pump system and presenting information regarding such monitoring are substantially shown in and/or described in connection with at least one of the figures, and are set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Aspects of the present invention are related to monitoring a sump pump system. More specifically, certain embodiments of the present invention relate to apparatus, hardware and/or software systems, and associated methods that monitor operation of a sump pump system and send notification to the homeowner of possible issues with the operation of the system so that the homeowner may take remedial action to avoid or reduce the effects of a sump overflow.

Figure 1:
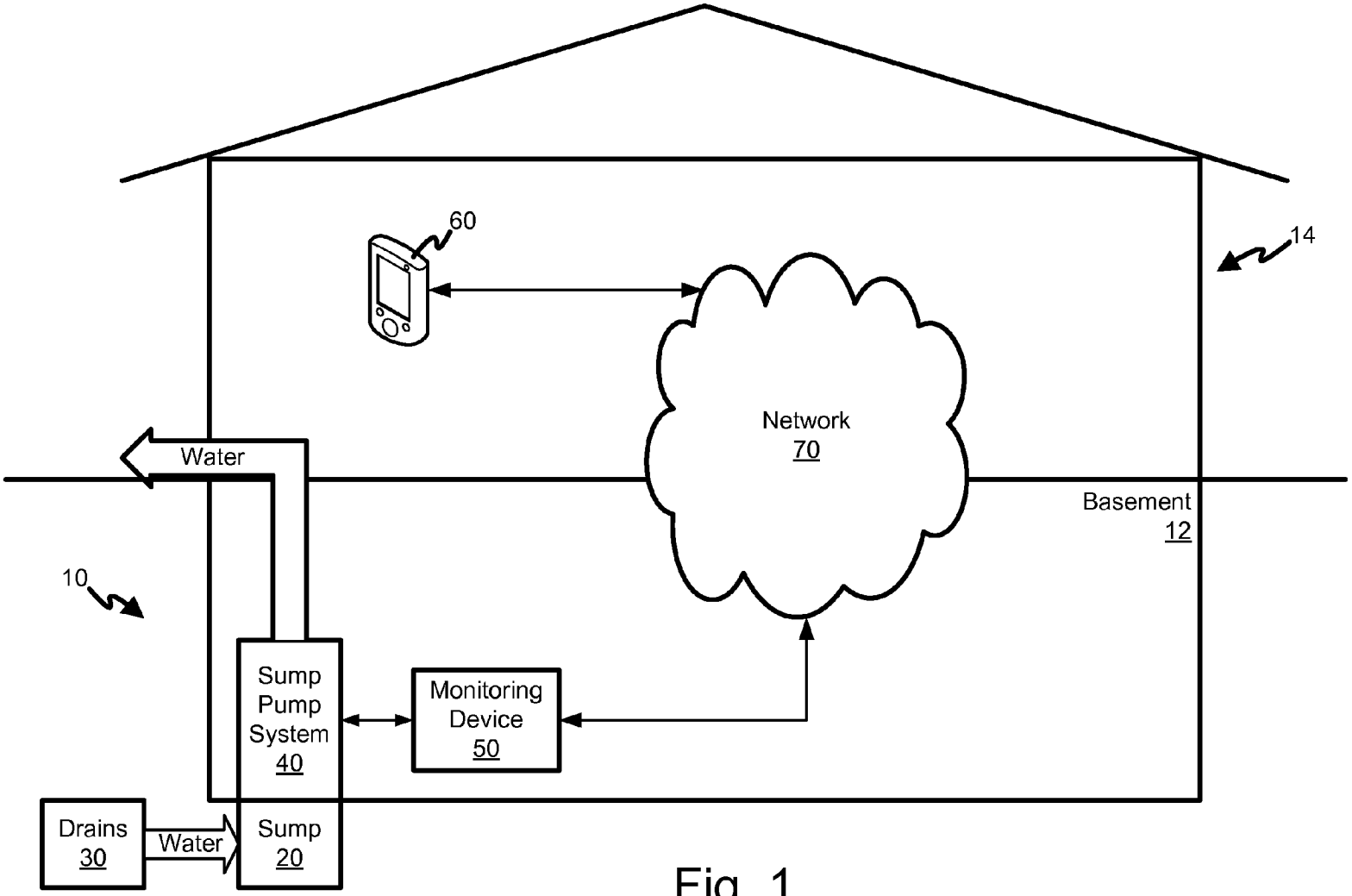
FIG. 1 shows an example water proofing system comprising a sump pump system and a monitoring device in accordance with an embodiment of the present invention.

FIG. 1 depicts an example waterproofing system 10. In particular, the waterproofing system 10 attempts to prevent flooding of a basement 12 of a home 14 by collecting ground water from the region about the basement 12 and discharging the collected water away from the home 14. To this end, the waterproofing system 10 may include a sump 20 which extends below floor level of the basement 12 and drains 30 which collect ground water from the region about the basement 12 and funnel such collected water toward the sump 20. A sump pump system 40 may pump water from the sump 20 and discharge the water away from the home 14.

In order to ensure the sump pump system 40 is operating as intended, the waterproofing system 10 may further include a separate monitoring device 50. The monitoring device 50 may monitor the sump pump system 40, determine an operating status of the sump pump system 40, and report the determined status. In particular, the monitoring device 50 may display the determined status and/or send a status message to a communications device 60 via communications network 70.

FIG. 1 depicts network 70 in home 14. However, network 70 may include several networks such has home area networks (HAN), local area networks (LAN), wide area networks (WAN), plain old telephone networks (POTS), cellular telephone networks, personal area networks (PAN), etc. which may extend beyond the scope of the home 14.

Figure 2:
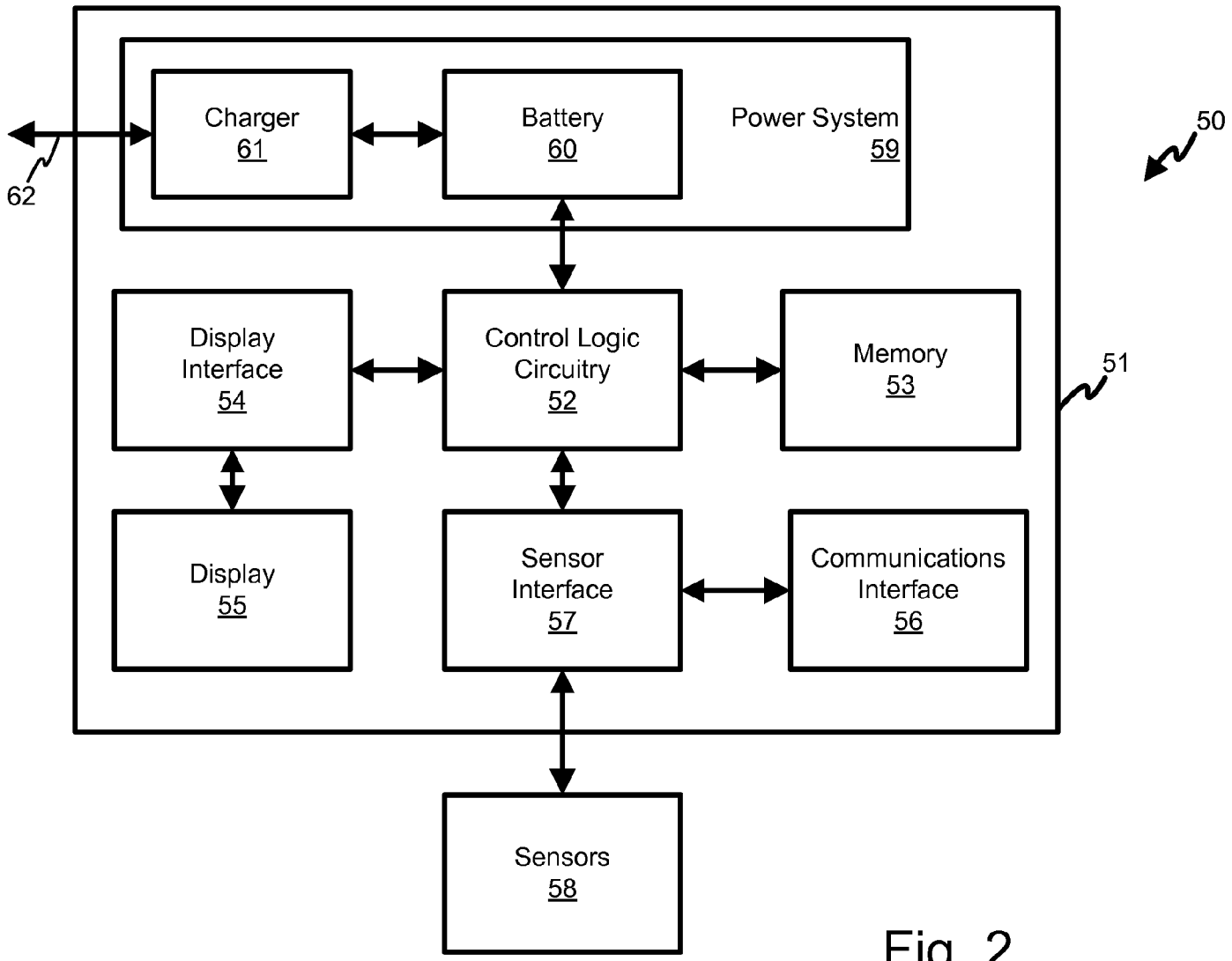
FIG. 2 shows an example embodiment of the monitoring device of FIG. 1.

Turning now to FIG. 2, the monitoring device 50 is shown in greater detail. As shown, the monitoring device 50 may include a housing 51 in which control logic circuitry 52, memory 53, a display interface 54, a display 55, a communications interface 56, and a sensor interface 57 are housed. The control logic circuitry 52 may include a microprocessor, a microcontroller, a field programmable gate array, and/or some other digital and/or analog circuitry that controls the operation of the monitoring device 50. The memory 53 may include volatile and/nonvolatile memory devices that may store data processed by and/or generated by the control logic circuitry 52 during the process of monitoring the sump pump system 40. Memory devices of the memory 53 may further store software and/or firmware instructions which the control logic circuitry 52 may execute in order to carry out one or more monitoring processes of the sump pump system 40.

The display interface 54 may interface the control logic circuitry 52 with the display 55. In particular, the display interface 54 may include circuitry that generates one or more video signals that drive the display 55. Via the display interface 54 and the display 55, the control logic circuitry 52 may present to the homeowner and/or another interested party information regarding the operating status of the sump pump system 40.

The communications interface 56 may interface the control logic circuitry 52 with the communications network 70. To this end, the communications interface 56 may include circuitry and possibly firmware that implement one or more communications protocols. In one embodiment, the communications interface 56 comprises circuitry that implements one or more communications protocols such as, for example, WiFi (e.g., IEEE 802.11 standards-based) protocols, Z-Wave protocols, ZigBee (e.g., IEEE 802.15 standards-based) protocols, Bluetooth (e.g., IEEE 802.15.1 standards-based) protocols, Ethernet (e.g., IEEE 802.3 standards-based) protocols, and/or other wireless and/or wired based communication protocols. Such protocols may permit the communications interface 56 to communicate with communications device 60 via network 70.

For example, communications interface 56 may permit the monitoring device 50 to connect to a local WiFi network 70 that provides a gateway to the Internet. Via such connection, the monitoring device 50 may send a status message to a communications device 60 such as a smart phone, laptop, tablet, desktop, or another computing device using various communications protocols such as email, instant messaging, text messaging, etc Alternatively or additionally, the communications interface 56 may provide the control logic circuitry 52 with a telephony interface. For example, the communications interface 56 may include a standard RJ-11 telephone jack that permits connecting a plain old telephone system to the monitoring device 50. Such a connection may permit the monitoring device 50 to call a specified number in order to contact the homeowner and/or another interested party and provide status information via a telephone network 70 and a communications device 60 such as a land line telephone or a cellular telephone. The telephony interface may further include cellular telephone support that may permit the monitoring device 50 to wirelessly send a text message and/or place a call to a specified number via a cellular telephone network without first connecting to a local land line.

As shown, the monitoring device 50 may further include a sensor interface 57. The sensor interface 57 may interface the control logic circuitry 52 with one or more sensor 58 such that the control logic circuitry 52 may receive signals indicative of various operating characteristics of the sump pump system 40. Via such received signals, the control logic circuitry 52 may monitor the operation of the sump pump system 40 and determine based upon such signals whether there may be an issue with its operation that warrants reporting such issue to the homeowner and/or another interested party.

The monitoring device 50 may further include a power system 59 configured to deliver operating power to the electrical components of the monitoring device. To this end, the power system 59 may include a rechargeable battery 60 and a charger 61 configured to charge the battery 60 via AC power supplied via power cord 62. The battery 60 may permit the monitoring device 50 to continue to operate in the presence of an AC power outage. In some embodiments, the power system 59 may include a battery compartment to receive user-serviceable batteries (e.g., standard AA batteries). In such embodiments, the user-serviceable batteries may provide the sole power for the monitoring device 50 thus eliminating the rechargeable battery 60, the charger 61, and power cord 62. In other embodiments, the user-serviceable batteries may replace the rechargeable battery 60 and charger 61 and merely provide backup power in the case of an AC power outage.

Figure 3:
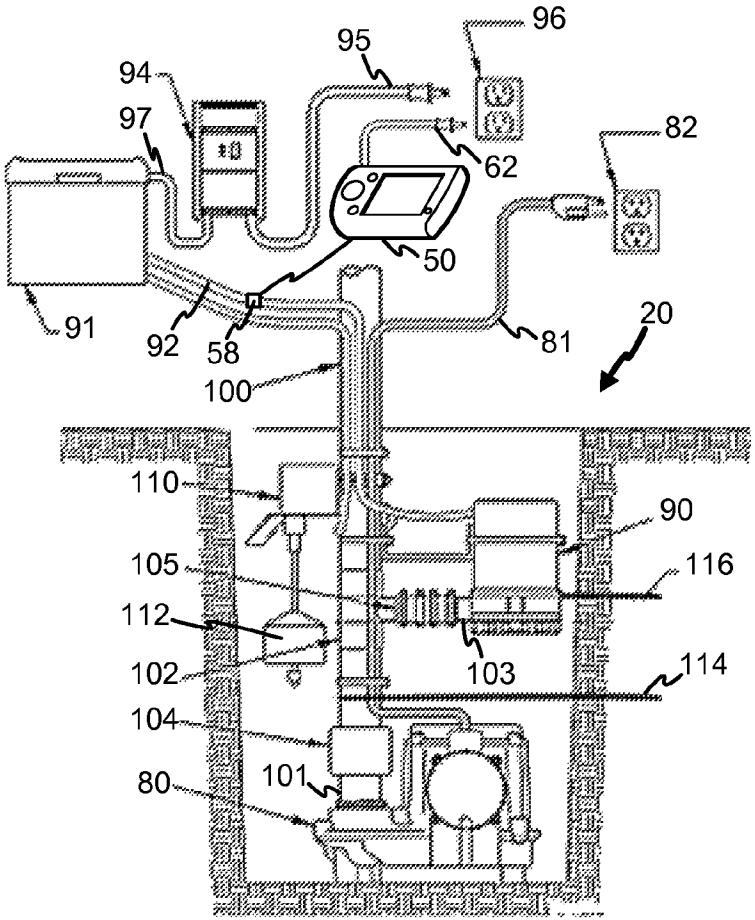
FIG. 3 shows the monitoring device connected to the sump pump system of FIG. 1 in a first manner.

Turning now to FIG. 3, further details regarding a first embodiment in which the monitoring device 50 has a single current clamp sensor 58 for monitoring DC power supplied to a DC pump of the sump pump system 40. As shown, the sump pump system 40 includes a primary pump 80 positioned toward the bottom of the sump 20. The primary pump 80 is designed to be powered by an AC power source. As such, the primary pump 80 includes a power cord 81 that may be plugged into an AC power outlet 82 of the home 14 in order to supply the primary pump 80 with AC electrical power needed for its operation.

The sump pump system 40 further includes a backup pump 90 positioned in the sump 20 but at a level higher than the primary pump 80. The backup pump 90 is designed to be powered by a DC power source. As such, the sump pump system 40 may further include a rechargeable battery 91 which powers the backup pump 90 via a DC power supply lead or wire 92. To ensure the battery 91 remains charged, the sump pump system 40 further includes a batter charger 94. The batter charger 94 may include a power cord 95 which may be plugged into a AC power outlet 96 of the home 14. The battery charger 94 may further include a DC power lead or wire 97 that delivers DC power to the battery 91. The battery charger 94 may transform AC power received from the AC power outlet 96 and power cord 95 to DC power suitable for charging the battery 91 and supplies the battery 91 with such DC power to keep the battery properly charged.

As shown, the sump pump system 40 may further include a common discharge pipe 100 which receives water from pumps 80, 90 and carries the received water away from the home 14. To this end, the discharge pipe 100 may be coupled to both the primary pump 80 and the backup pump 90. In particular, a lower end 101 of the discharge pipe 100 may be connected to the primary pump 80. The discharge pipe 100 may be further fitted with a tee 102 that is positioned above the lower end 101. A distal end 103 of the tee 102 may be coupled to the backup pump 90 thereby connecting the backup pump 90 to the discharge pipe 100. Furthermore, to prevent back flow into the primary pump 80, a first check valve 104 is positioned between the primary pump 80 and the tee 102. Similarly, to prevent back flow into the backup pump 90, a second check valve 105 is positioned between the backup pump 90 and the discharge pipe 100.

As shown, the sump pump system 40 may further include a float activate switch 110. The float activated switch 110 may include one or more floats 112. The floats 112 may be positioned such that the float activated switch 110 turns on the primary pump 80 in response to water in the sump 20 reaching a first water level 114 and turns on the backup pump 90 in response to water in the sump 20 reaching a second water level 116 that is higher than the first water level 114. The float activated switch 110 may further turn off the pumps 80, 90 after the water level in the sump 20 sufficiently recedes.

Besides the sump pump system 40, FIG. 3 further depicts the monitoring device 50 connected to the power outlet 96 via power cord 62 and to the sump pump system 40 via a current clamp 58. In particular, the current clamp 58 is clamped to the DC supply lead 92 via which the battery 91 supplies the backup or DC pump 90 with DC power. The current clamp or probe 58 may be implemented as an electrical device having two jaws which open to allow clamping around an electrical conductor such as the lead 92. Such an implementation may permit properties of the electric current in the lead 92 to be sensed, without having to make physical contact with the conductor of the lead 92, or to disconnect the lead 92 for insertion through the clamp 58.

Via the current clamp 58, the monitoring device 50 may monitor power supplied to the DC pump 90 by the battery 91. Based upon the sensed supplied power, the monitoring device 50 may detect whether a potential fault state of the sump pump system 40 and report the potential fault state to the homeowner or another interested party so that remedial action may be taken. For example, based on sensing a sufficient flow of DC current between the battery 91 and the DC pump 90, the monitoring device 50 may determine that:

1) water is flowing into the sump 20 faster than the AC or primary pump 80 is able to discharge the water;
2) the AC pump 90 is not running due to the AC pump 90 malfunctioning; and/or
3) there is a power outage that is preventing the supply of AC power to the AC pump 80 thus causing the DC pump 90 to run from battery 91.

The monitoring device 50 may then report such detected status of the sump pump system 40 via the display 55 and/or communication device 60.

Figure 4:
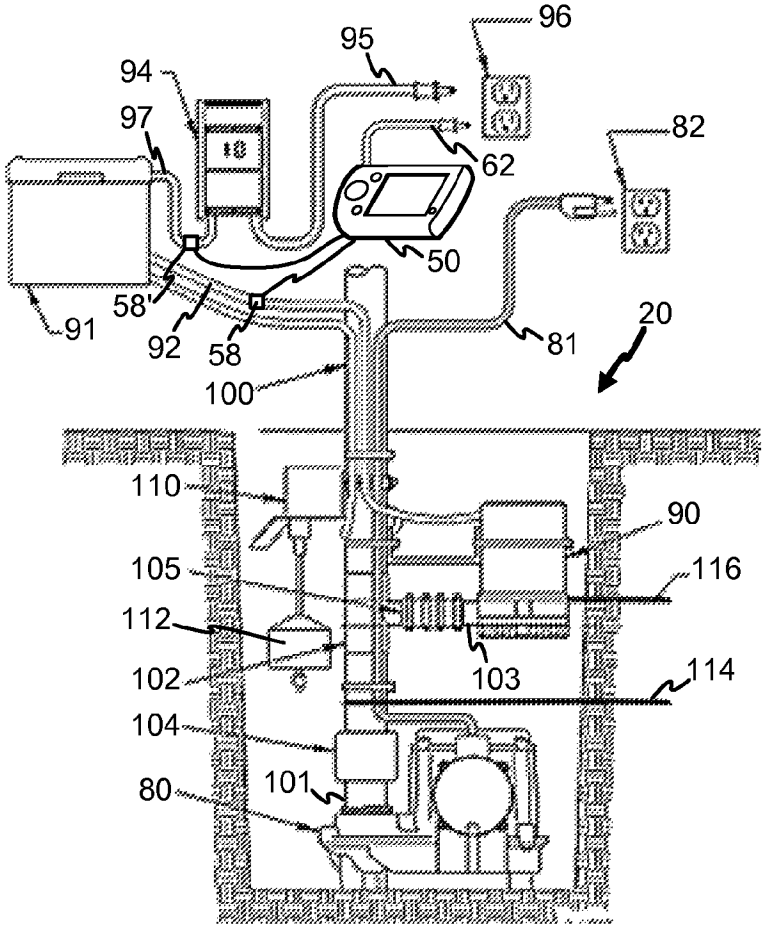
FIG. 4 shows the monitoring device connected to the sump pump system of FIG. 1 in a second manner.

Referring now to FIG. 4, the monitoring device 50 is shown with a second connection to the sump pump system 40. In particular, the monitoring device 50 may include a current first clamp 58 that is clamped to the DC supply lead 92. Via the current first clamp 58, the monitoring device 50 may monitor power supplied to the DC pump 90 by the battery 91 as explained above in regard to FIG. 3. The monitoring device 50 may further include a second current clamp 58' that is clamped to the lead 97 via which the charger 94 charges the battery 91.

Thus, the monitoring device 50 may determine, based on sensing a sufficient flow of DC current between the battery 91 and the DC pump 90, that:

1) water is flowing into the sump 20 faster than the AC or primary pump 80 is able to discharge the water;
2) the AC pump 90 is not running due to the AC pump 90 malfunctioning; and/or
3) there is a power outage that is preventing the supply of AC power to the AC pump 80 thus causing the DC pump 90 to run from battery 91.

Moreover, based on sensed current between the battery charger 94 and the batter 91, the monitoring device 50 may further detect that the battery 91 needs charging and has therefore been used. The monitoring device 50 may then report such detected status of the sump pump system 40 via the display 55 and/or a communication device 60.

Figure 5:
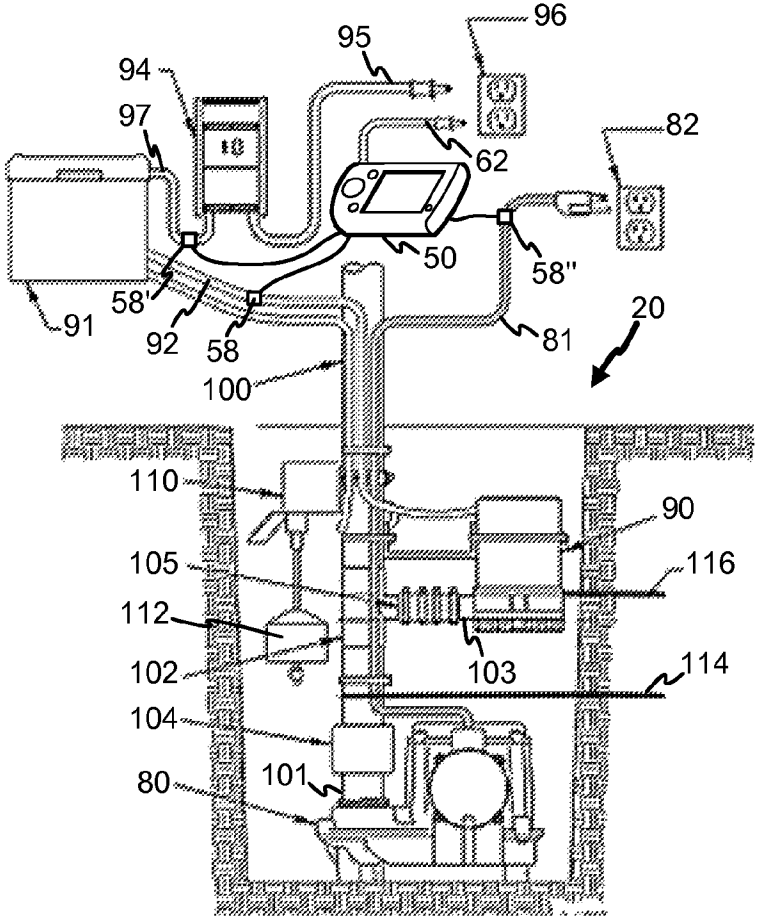
FIG. 5 shows the monitoring device connected to the sump pump system of FIG. 1 in a third manner.

Referring now to FIG. 5, the monitoring device 50 is shown with a third connection to the sump pump system 40. In particular, the monitoring device 50 may include the current first clamp 58 that is clamped to the DC supply lead 92, the second current clamp 58' that is clamped to lead 97, and a third sensor 58" configured to sense AC current supplied to the AC pump 80. The third sensor 58" may be implemented using a third current clamp that may be coupled to the power cord 81 for the AC pump 80 in a manner similar to the current clamps 58, 58'. However, since the power cord 81 may be easily unplugged from the power outlet 82, the third sensor 58" may be implemented as an in-line sensor that is plugged into the outlet 82 and that provides a sensed power outlet into which the power cord 81 may be plugged in order to receive AC power that is sensed by the sensor 58". In yet another embodiment, the monitoring device 50 may implement the third sensor 58" as an integrated power outlet of the monitoring device 50. In such an embodiment, the power cord 81 for the AC pump 80 may be plugged directly into the monitoring device 50.

In embodiments in which the third sensor 58" is implemented as an in-line sensor or and integrated power outlet, the monitoring device 50 may further control or turn off power delivered to the AC pump 80. The monitoring device 50 may utilize this control feature to further analzye and/or diagnosis the operating status or condition of the AC pump 80.

As a result of such connections, the monitoring device of FIG. 5 may detect the same operating status information as the monitoring device of FIG. 4. However, the monitoring device of FIG. 5 may further refine such detected status based upon the sensed AC current, voltage, and/or power delivered to the AC pump 80. In particular, based on the third sensor 58", the monitoring device 50 may determine whether the AC pump is running. If current is detected for both the AC pump 80 and the DC pump 90, the monitoring device 50 may determine that the AC pump is unable to keep up with water ingress. Furthermore, the monitoring device 50 based on power being supplied to the DC pump 90 and not to the AC pump 80, the monitoring device 50 may detect that there is a faulty AC pump 80 and/or an AC power failure.

Furthermore, the monitoring device 50 may maintain historical data for the operation of the AC pump 80 and the DC pump 90. Such data may help ascertain whether the AC pump 80 provides sufficient pump capacity and/or is operating efficiently. If both the AC pump 80 and the DC pump 90 are running a significant percentage of the time, then the AC pump 80 may be undersized or not operating correctly.

Figure 6:
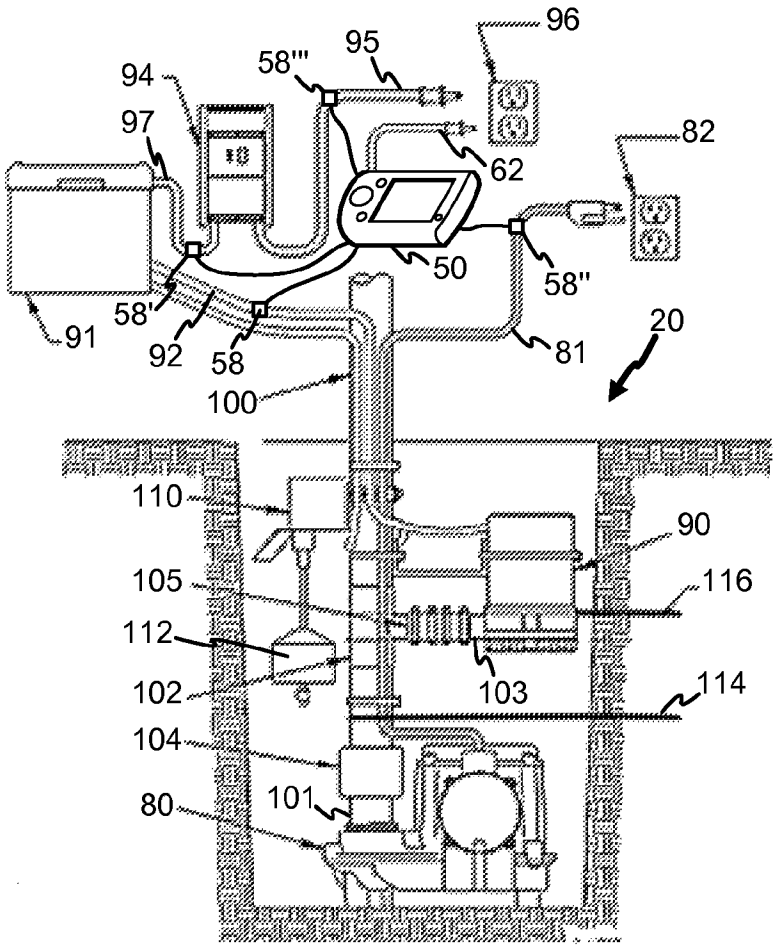
FIG. 6 shows the monitoring device connected to the sump pump system of FIG. 1 in a fourth manner.

Referring now to FIG. 6, the monitoring device 50 is shown with a fourth connection to the sump pump system 40. In particular, the monitoring device 50 may include the current first clamp 58 that is clamped to the DC supply lead 92, the second current clamp 58' that is clamped to lead 97, the third sensor 58" configured to sense AC current and/or voltage supplied to the AC pump 80, and a fourth sensor 58'" configured to sense AC current and/or voltage supplied to the battery charge 94. The fourth sensor 58'" may be implemented in a manner similar to that used to implement the third sensor 58" since the power cord 95 for the charger 94 is easily unplugged from the outlet 96. In particular, the fourth sensor 58'" may be implemented as a current clamp, an in-line sensor, and/or a power outlet of the monitoring device 50.

As a result of such connections, the monitoring device of FIG. 6 may detect the same operating status information as the monitoring device of FIG. 5. However, the monitoring device of FIG. 6 may further refine such detected status based upon the sensed AC current, voltage, and/or power delivered to the charger 94. In particular, based on the fourth sensor 58'", the monitoring device 50 may monitor and/or control the operation of the charger 94. In particular, the monitoring device 50 may monitor and compare the AC input of the charger 94 to the DC output of the charger 94. The monitoring device 50 may further maintain a history of such AC input to DC output data. Based on such data, the monitoring device 50 may further detect a fault or predict a possible future fault of the charger 94.

Figure 7:
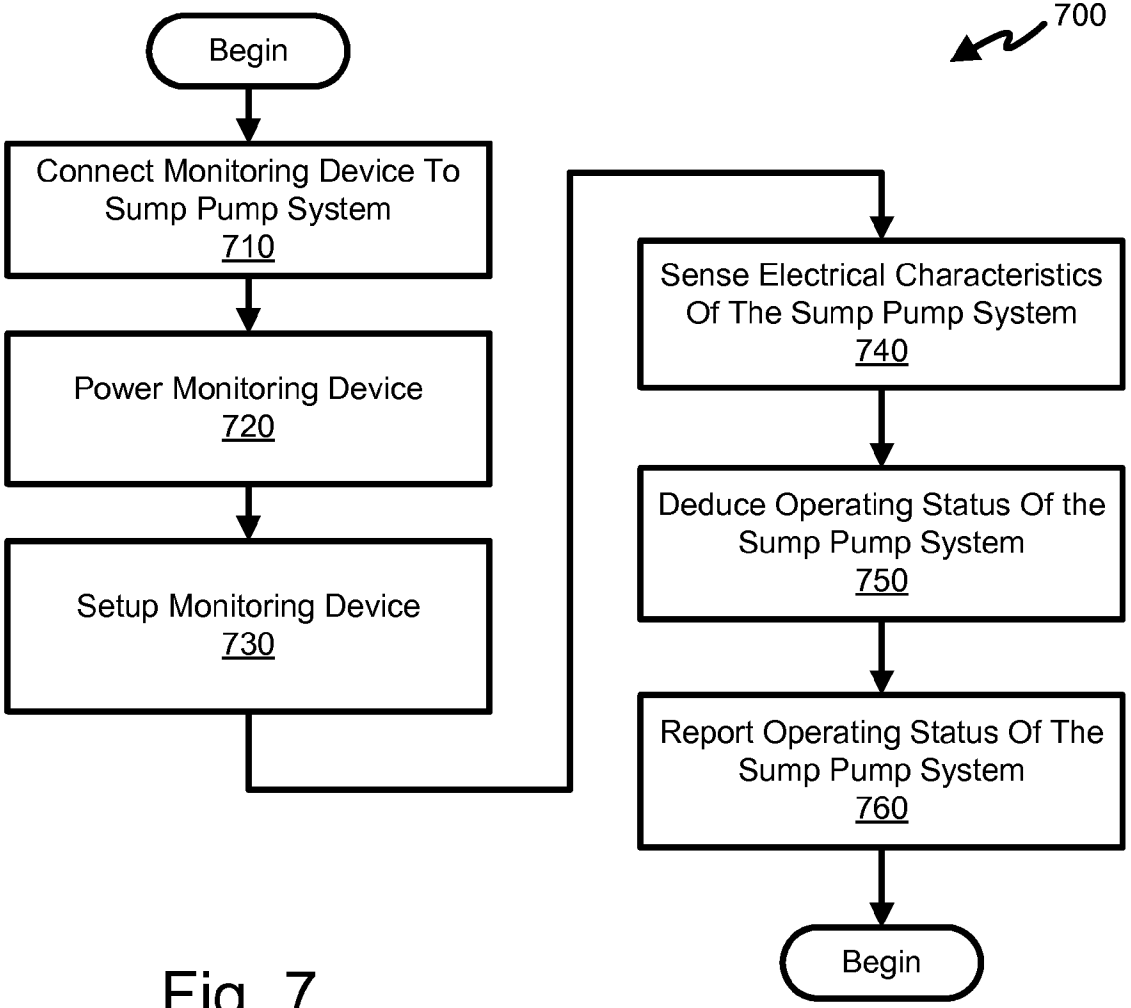
FIG. 7 shows a flowchart of an example method of installing and operating the monitoring device of FIG. 1.

Referring now to FIG. 7, a method 700 of installing and operating a sump pump monitoring device 50 with an already installed sump pump system 40 is shown. The method 700 is described from the standpoint of a homeowner installing the monitoring device 50 in order to emphasis the ease by which the monitoring device 50 may be installed. However, it should be appreciated that the method of installation is not solely limited to homeowner installations. For example, a homeowner may still hire a technician to perform the installation.

At 710, a homeowner may connect one or more sensors 58 of the monitoring device 50 to the sump pump system 40. In one embodiment, the monitoring device 50 may utilize clamp sensors 58 that permit sensing electrical characteristics without requiring disconnecting electrical leads or wires of the sump pump system 40. For example, the homeowner may connect a clamp sensor 58 to the lead 92 between battery 91 by opening jaws of the clamp sensor 58 to permit the lead 92 to pass by the jaws and closing the jaws of the clamp sensor 58 so that the jaws close around the lead 92. Thus, the homeowner may attach the sensor 58 to the lead 92 such that the lead 92 passes through the sensor 58 without disconnecting the lead 92 from the battery 91 or the DC pump 90. The homeowner may user a similar process to connect clamp sensors 58 around the lead 97 between the charger 94 and the battery 91, around the power cord 95 for the charger 94, and around the power cord 81 for the AC pump 80.

Such clamp sensors 58 may greatly ease installation of the monitoring device 50 since no existing electrical leads or connections are disconnected during the installation process. As noted above, the monitoring device 50 may alternatively include in-line sensors for the power cords 81, 95. Such an embodiment does not greatly increase the difficulty of installation. Unplugging the power cords 81, 95 from the electrical outlets 82, 96 and then plugging them into the in-line sensors 58 requires no tools. Moreover, such a process is one that most homeowner should feel comfortable performing.

At 720, the homeowner may plug the power cord 62 of the monitoring device 50 into a power outlet 82, 96 in order to supply AC power to the monitoring device 50. In some embodiments, the monitoring device 50 may operate solely from an internal user-serviceable batteries as discussed above. In such an embodiment, the homeowner may place suitable batteries into a battery compartment of the monitoring device 50.

The homeowner at 730 may configure and/or setup the monitoring device 50. To this end, the monitoring device 50 via display 55 may ask the homeowner to answer a series of questions which configure the monitoring device 50. For example, via the setup process, the homeowner may select a mode of communication to be used to report status to the homeowner. For example, the homeowner may supply an email address, the telephone number, etc. which the monitoring device 50 may use to contact a communication device 60. Moreover, the setup process may permit the homeowner to provide or select various information (e.g., WEP passwords, IP gateway address, network identifier, etc.) needed by the monitoring device 50 in order to connect to the network 70. However, in some embodiments, the monitoring device 50 may be capable of automatically discovering and connecting to the network 70 without intervention from the homeowner.

After installation and setup, the monitoring device 50 at 740 may sense various electrical operating characteristics of the sump pump system 40 via the sensors 58. As explained above, the monitoring device 50 via sensors 58 may be able to sense DC current and/or voltage supplied to the battery 91 and sense DC current and/or voltage supplied to the DC pump 90. Via sensors 58, the monitoring device 50 may be able to further sense AC current and/or voltage supplied to the charger 94 and sense AC current and/or voltage supplied to the AC pump 80.

At 750, the monitoring device 50 may deduce an operating status of the sump pump system 40 based on the sensed electrical characteristics. For example, the monitoring device 50 may be able to deduce whether the AC pump is running, whether the DC pump is running, whether there is an AC power outage, etc, based upon the sensed electrical characteristics.

Finally, the monitoring device 50 at 760 may report the deduced operating status. In particular, the monitoring device 50 may present the status upon the display 55. The monitoring device 50 may also send a reporting message to a communications device 60 via the network 70. To this end, the monitoring device 50 may utilize information provided via the setup process to place a call, send an email message, etc. to the communications device 60 such that an interested party (e.g., homeowner, landlord, property management company, etc.) may be informed of the deduced operating status of the sump pump system 40. Such reporting may enable an interested party that is remotely located and away from the home 14 to receive information regarding an operating status of the sump pump system 40 and undertake appropriate remedial action in light of such information.

Various embodiments of the invention have been described herein by way of example and not by way of limitation in the accompanying figures. For clarity of illustration, exemplary elements illustrated in the figures may not necessarily be drawn to scale. In this regard, for example, the dimensions of some of the elements may be exaggerated relative to other elements to provide clarity. Furthermore, where considered appropriate, reference labels have been repeated among the figures to indicate corresponding or analogous elements.

Moreover, certain embodiments may be implemented as a plurality of instructions on a non-transitory, computer readable storage medium such as, for example, flash memory devices, hard disk devices, compact disc media, DVD media, EEPROMs, etc. Such instructions, when executed by control logic circuitry 52, may result in the monitor device 50 implementing various previously described monitoring, deducing, and/or reporting aspects of monitoring device 50.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment or embodiments disclosed, but that the present invention encompasses all embodiments falling within the scope of the appended claims.

What is claimed is:

1. A method of monitoring operation of a sump pump system, comprising:

receiving signals via a current clamp of a monitoring device coupled to an electrical wire of the sump pump system;

sensing, via the monitoring device, electrical characteristics of the electrical wire based on the received signals; and deducing, with the monitoring device, an operating status of the sump pump system based upon the sensed electrical characteristics.

2. The method of claim 1, further comprising reporting the deduced operating status.

3. The method of claim 1, further comprising reporting the deduced operating status to an interested party via a communication device.

4. The method of claim 1, further comprising reporting the deduced operating status to an interested party via a home area network.

5. The method of claim 1, further comprising displaying the deduced operating status upon a display of the monitoring device.

6. The method of claim 2, wherein said reporting comprises wirelessly sending a message that provides the deduced operating status to an interested party via a home area network.

7. The method of claim 1, wherein said placing the current clamp comprises clamping the current clamp to an electrical wire used to supply battery power to a battery operated pump the sump pump system.

8. The method of claim 1, wherein said placing the current clamp comprises clamping the current clamp to an electrical wire used to charge a battery that powers a pump of the sump pump system.

9. The method of claim 1, further comprising:

sensing AC power supplied to an AC pump of the sump pump system; and deducing further operating status information for the sump pump system based upon sensed AC power supplied to the AC pump.

10. The method of claim 1, further comprising:

sensing AC power supplied to a battery charger of the sump pump system; and deducing further operating status information for the sump pump system based upon sensed AC power supplied to the battery charger.

11. A monitoring device for monitoring a sump pump system, comprising:

a plurality of electrical sensors configured to sense electrical characteristics of the sump pump system, wherein the plurality of electrical sensors comprises a current clamp configured to be clamped around an electrical wire of the sump pump system;

control logic circuitry configured to monitor the sensed electrical characteristics of the existing sump pump system and deduce an operating status based on the sensed electrical characteristics; and a communications interface configured to report the deduced operating status to an interested party via a communications device.

12. The monitoring device of claim 11, wherein the control logic circuitry is configured to deduce and report that the DC pump is running based on sensed electrical characteristics received via the current clamp.

13. The monitoring device of claim 11, further comprising a display, wherein the control logic circuitry is further configured to cause the display to present the deduced operating status.

14. The monitoring device of claim 11, wherein said communication interface is configured to wirelessly send a reporting message to the communication device via a network.

15. The monitoring device of claim 11, wherein said control logic circuitry is further configured to deduce whether a DC pump of the sump pump system is running based on the sensed electrical characteristics.

16. The monitoring device of claim 11, wherein said control logic circuitry is further configured to deduce whether an AC pump of the sump pump system is running based on the sensed electrical characteristics.

17. The monitoring device of claim 11, wherein said control logic circuitry is further configured to deduce whether a DC pump and an AC pump of the sump pump system are simultaneously running based on the sensed electrical characteristics.

18. The monitoring device of claim 11, wherein said control logic circuitry is further configured to deduce whether AC power is being supplied to the sump pump system.

19. The monitoring device of claim 11, wherein said control logic circuitry is further configured to deduce whether a charger is charging a battery of the sump pump system.

20. The monitoring device of claim 11, wherein said control logic circuitry is further configured to maintain a history that compares operation of a DC pump of the sump pump system to operation of an AC pump of the sump pump system.

* * * * *